United States Patent [19]

Holz

[11] 4,010,395

[45] Mar. 1, 1977

[54] GAS DISCHARGE DISPLAY PANEL WITH CELL-FIRING MEANS HAVING GLOW SPREADING ELECTRODE

[75] Inventor: George E. Holz, North Plainfield, N.J.

[73] Assignee: Burroughs Corporation, Detroit, Mich.

[22] Filed: Feb. 9, 1976

[21] Appl. No.: 656,656

[52] U.S. Cl. ..... 313/188; 313/198; 313/217

[51] Int. Cl.[2] ..... H01J 61/067; H01J 61/54

[58] Field of Search ..... 313/188, 217, 198, 197

[56] References Cited

UNITED STATES PATENTS

| | | | |
|---|---|---|---|
| 2,847,615 | 8/1958 | Engelbart | 315/169 R X |
| 3,654,508 | 4/1972 | Caras | 313/198 |
| 3,863,088 | 1/1975 | Harvey et al. | 313/217 X |

*Primary Examiner*—Palmer C. Demeo

*Attorney, Agent, or Firm*—Kevin R. Peterson; Robert A. Green

[57] ABSTRACT

A display panel includes an array of scanning or priming cells disposed in rows and columns and having electrodes for energizing each column of cells sequentially in a scanning cycle. An auxiliary column of reset cells is provided adjacent to the first column of scanning cells of the series to insure that all of the scanning cells in the column are energized at the beginning of a scanning cycle. In addition, a glass-coated wire electrode is provided adjacent to the column of reset cells, and it is energized in such a way as to insure that all of the reset cells are energized as required.

5 Claims, 4 Drawing Figures

Fig. 2
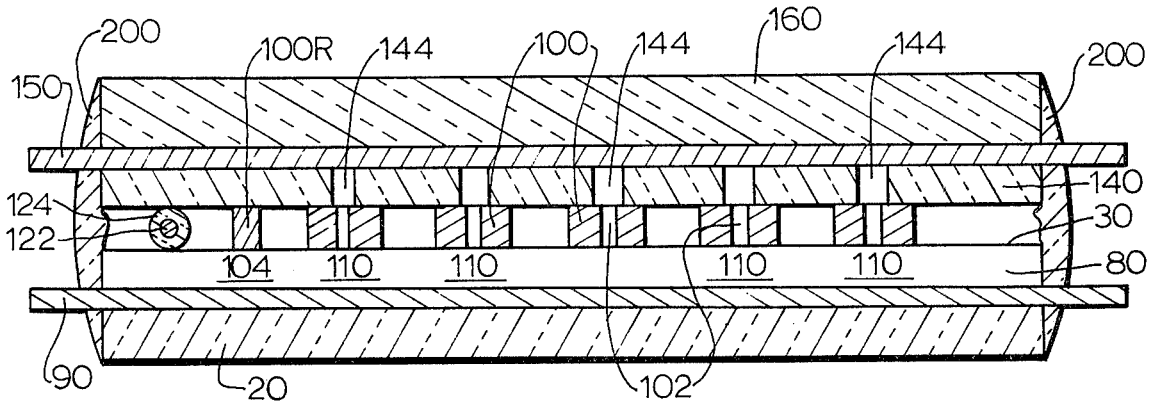
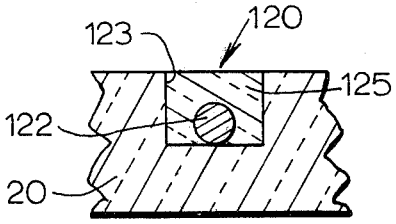
Fig. 3

GAS DISCHARGE DISPLAY PANEL WITH CELL-FIRING MEANS HAVING GLOW SPREADING ELECTRODE

BACKGROUND OF THE INVENTION

The present invention relates to dot matrix panels of the type known as SELF-SCAN panels which are manufactured and sold by Burroughs Corporation. One type of SELF-SCAN panel is shown in U.S. Pat. No. 3,821,586. These panels include rows and columns of scanning or priming cells and associated display cells and their associated electrodes. In operation, the columns of scanning cells are scanned or energized sequentially, beginning with an arbitrarily designated first column, in repeated scanning cycles, and simultaneously selected associated display cells are energized to display information. Such panels include an auxiliary column of cells, known as reset cells, adjacent to the designated first column of scanning cells for use in providing a source of excited particles for all of the cells in the first column of scanning cells to insure that all of the scanning cells turn on at the beginning of a scanning cycle. Under some circumstances, all of the reset cells either do not turn on, or they do not all turn on sufficiently rapidly to insure that all of the scanning cells in the first column turn on as required. The present invention provides an arrangement which avoids this problem.

SUMMARY OF THE INVENTION

Briefly, according to the invention, in a panel of the type described above, an insulated glow-spreading electrode is provided for generating excited particles to insure energization of the reset cells of the panel.

DESCRIPTION OF THE DRAWINGS

FIG. 2 is a sectional view, along the lines 2-2 in FIG. 1, showing the panel of FIG. 1 assembled;

FIG. 3 is a sectional view of a portion of the panel of FIG. 1 showing a modification of a portion thereof.

DESCRIPTION OF THE PREFERRED EMBODIMENTS

Figure 1:
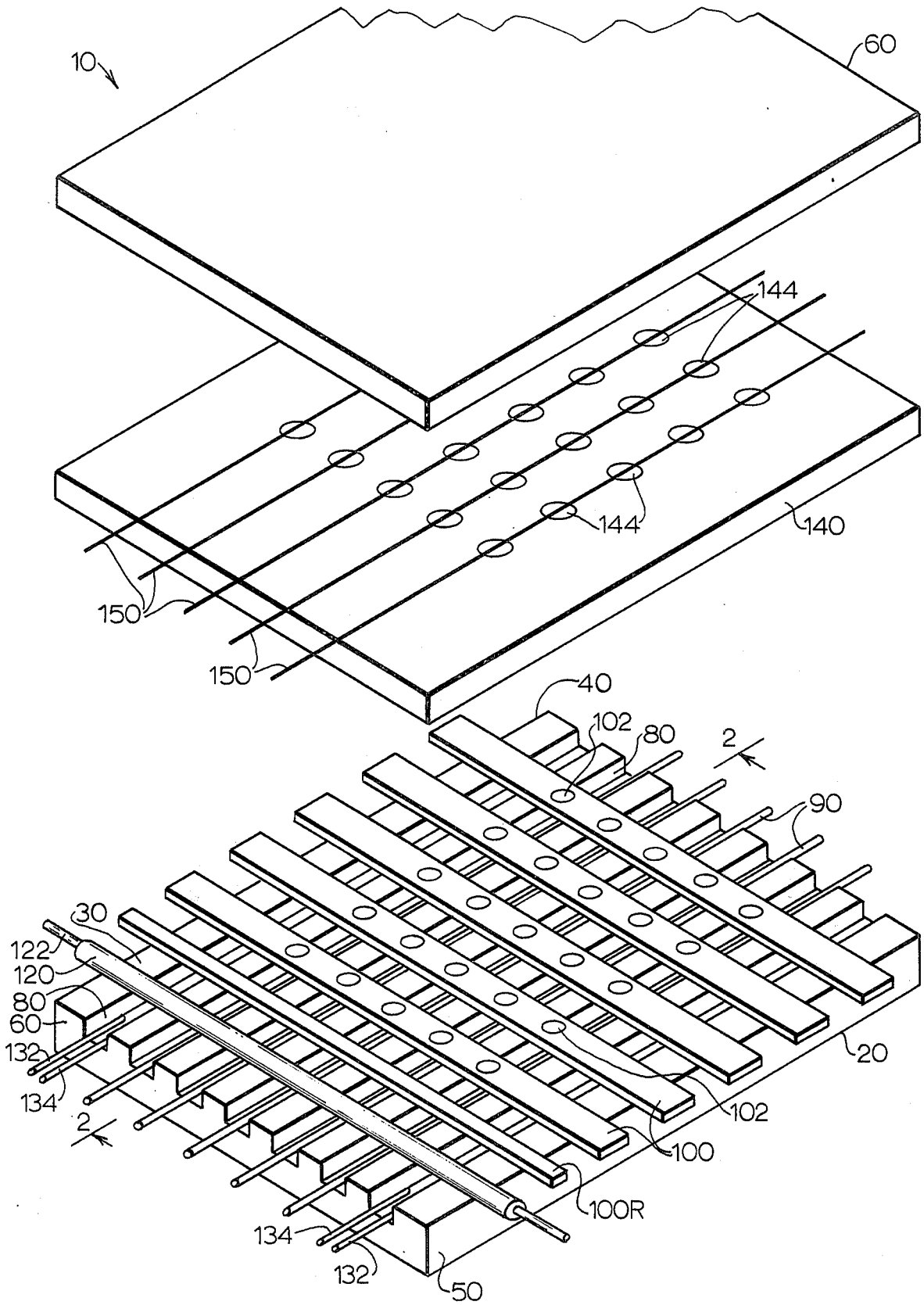
FIG. 1 is a perspective, exploded view of a display panel embodying the invention.

The principles of the present invention are particularly applicable to gas-filled SELF-SCAN panels of the type shown and described in U.S. Pat. Nos. 3,766,420, 3,821,586, and 3,654,508, which are incorporated herein by reference, and especially to large-multi-register panels of the type described in the last-named patent. However, to simplify the drawings, only sufficient structure will be shown and described below to illustrate the principles of the invention.

A display panel 10, embodying the invention, includes a base plate 20 of an hermetic, dielectric material, such as glass or ceramic, which has a top surface 30, an upper edge 40, a lower edge 50, a left edge 60, and a right edge 70. The plate 20 has a plurality of parallel slots or channels 80 formed in the top surface 30 thereof, and electrodes 90, which are used as priming or scanning anodes, in one mode of operation of the panel, are seated in the slots.

A plurality of electrodes 100, operated as scanning cathodes and comprising apertured metal strips, are disposed on the top surface 30 of the base plate 20, generally parallel to each other and oriented at 90° to the scanning anodes 90. Thus, each cathode 100 crosses each anode 90, and each such crossing defines a scanning or priming gas cell 110 (FIG. 2). Each electrode 100 is provided with a plurality of apertures 102 disposed along its length, with each aperture 102 being positioned over a slot 90 (FIG. 4) in bottom plate 20 and over a scanning cell 110. Each column of cathode apertures 102 is aligned with a column of scanning cells 110, and the rows of apertures 102 formed by the adjacent cathodes are each aligned with a row of scanning cells.

An unapertured cathode strip electrode 100R, known as a reset cathode, is disposed parallel to and adjacent to the leftmost apertured cathode 100, which is considered to be the first cathode of the group of scan cathodes. This cathode is also considered to define the first column of priming or scanning cells in the series of columns of scanning cells. The reset cathode 100R crosses each scanning anode 90, and each crossing defines a reset cell 104.

Figure 4:
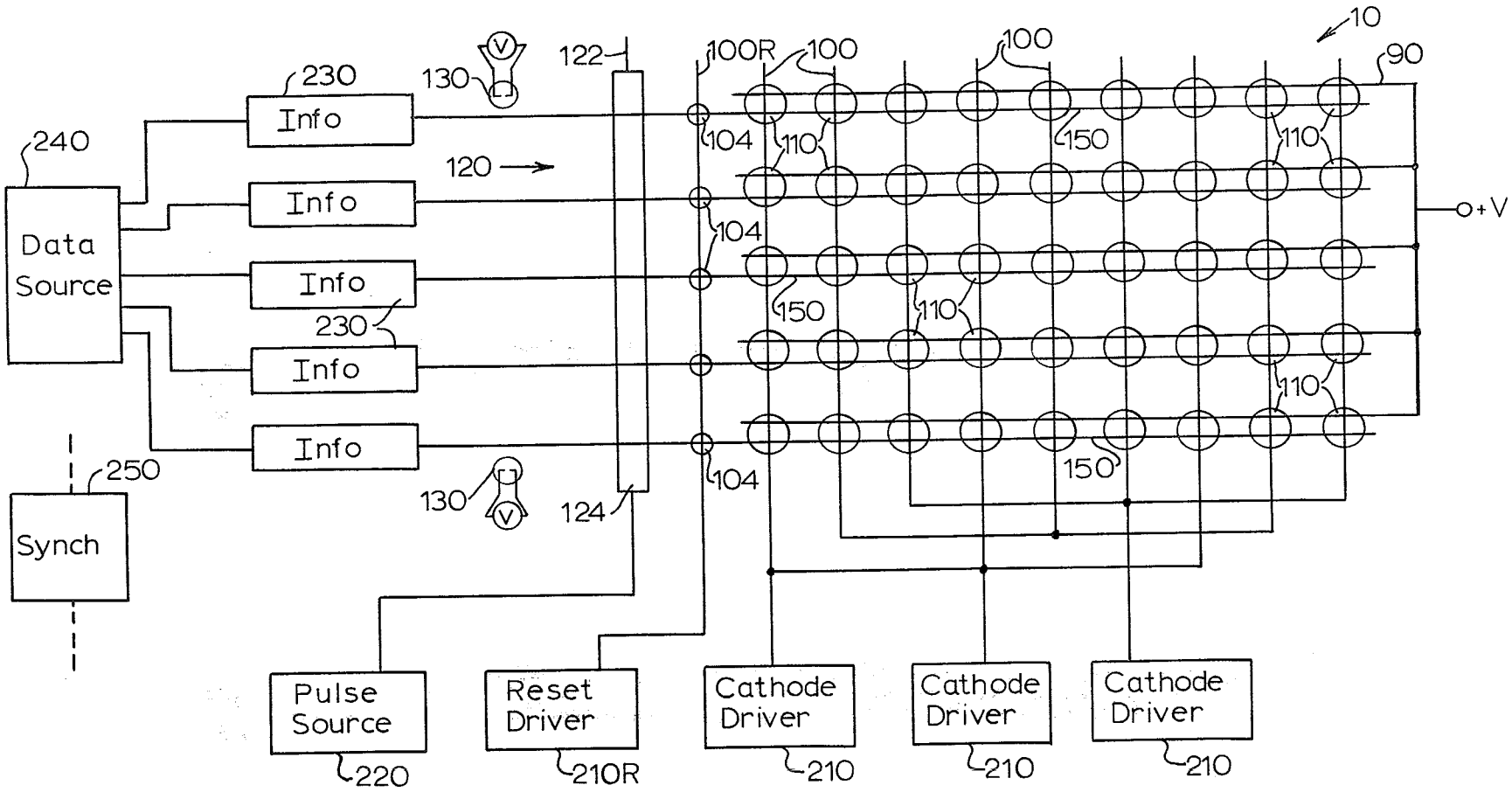
FIG. 4 is a schematic representation of the display panel of FIG. 1 and a system in which it may be operated.

According to the invention, an insulation-coated electrode 120 is seated on the base plate 20 adjacent to the reset cathode 100R. This electrode may comprise a wire or strip 122 coated with a layer of glass 124, and seated on base plate 20, or it may be the wire 122 seated in a slot 123 in the top surface of base plate 20, with the slot being filled with glass 125 to cover the wire. Thus, the wire or conductor 122 is insulated from the gas in panel 10 and the other electrodes. The insulated electrode 120 is operated or serves as a glow-spreading electrode, and, to insure proper operation thereof, two keep-alive cells 130 are provided in operative relation with the ends thereof (FIGS. 2 and 4). The keep-alive cells 130 may comprise two wires 132 and 134 seated in auxiliary slots 92 formed in the base plate near the ends of the spreading electrode (FIG. 1).

Panel 10 also includes an insulating center sheet 140 which is seated on base plate 20 and has a plurality of holes or cells 144 which are arrayed in rows and columns. The columns of holes are aligned with and overlie the columns of apertures 102 in cathodes 100 and the columns of scanning cells, and the rows of holes are generally aligned with and overlie the slots 90 and the rows of scanning cells.

A second group of wire electrodes 150, used as display anodes, are seated on or in the top surface 132 of apertured plate 140, one for each wire electrode 90 in base plate 20. Each anode electrode 150 is parallel to and aligned with an electrode 90, and is generally aligned with and overlies a row of cells 144 in center sheet 140. The anodes 150, cathodes 100, and cells 144 between them comprise display cells in panel 10.

A transparent glass cover or viewing plate 160 completes the panel and is seated on center plate 130, and, in the completed panel 10, the three plates 20, 140, and 160 are hermetically sealed together by a seal 200 (FIG. 2) formed along their adjacent edges by any suitable means such as a fused glass frit or the like.

The gas used in panel 10 is introduced in any suitable manner, as is well known to those skilled in the art, and it may be any suitable ionizable gas such as neon, argon, xenon, etc., singly or in combination, with a vapor of a metal such as mercury usually included in the gas to minimize cathode sputtering. The preferred gas is a Penning mixture at a pressure of about 200 torr.

At this time in the development of the display panel art, SELF-SCAN panels and their mode of operation are well known, and the operation will not be described in detail herein. However, for a brief description of the operation of the invention, reference is made to FIG. 4, which shows a schematic representation of panel 10 and some of its component parts and a schematic representation of circuit elements for operating the panel. In the circuit, the scan cathodes 100 are connected in groups, and each group is connected to a separate cathode driver 210. The reset cathode 100R is connected to a driver 210R, and spreading electrode 120 is connected to a driver 220 which is adapted to apply relatively large negative pulses thereto. The signals generated by cathode drivers 210, reset driver 210R, and driver 220 are all negative with respect to the scan anodes 90. Each of the keep-alive cells 130 is connected to a source of potential V so that the cells are always ON and generating excited particles. The scan anodes 90 are connected to a generally positive voltage V, and each of the display anodes 150 is connected to a source of information signals 230 which themselves receive signals from a data source 240 which may include a computer, encoders, decoders, character generators, and the like, as is well known in the art. Suitable synchronizing control circuits 250 are provided for synchronizing the operation of the various parts of the panel in the required manner. It is understood that the required current-limiting resistive paths are also provided for panel 10, as is well known.

Briefly, in operation of the panel 10, the columns of scanning cells 110 are energized separately and in turn, and simultaneously, information signals are applied to selected display anodes 150 to cause glow to transfer to the selected display cells from the associated scanning cells which are ON at that instant. This operation is carried out repeatedly throughout the panel at such a rate that a changeable but apparently stationary message is displayed by the energized display cells.

For proper operation of the panel, and in particular the scanning cells 110 thereof, when the first, or leftmost, column of scanning cells is energized, all of its cells must turn on. To insure that this proper operation occurs, the column of reset cells 104 is provided to the left of and closely adjacent to the first column of scanning cells 110, and the reset cells provide excited particles for turning on the first column of scanning cells. The excited particles diffuse thereto through slots 80. However, again, for proper operation, when the reset cells are energized, they must all turn on quickly and at substantially the same time. The combination of the keep-alive cells 130 and the insulated electrode 120 are provided to insure that the last operation occurs properly. According to the invention, the keep-alive cells 130 provide a constant source of excited particles in the vicinity of insulated electrode 120. When it is desired to begin a scanning cycle, a relatively large negative pulse (negative with respect to anodes 90) is applied from source 220 to the insulated electrode, and this causes the gas in the vicinity of the insulated electrode to ionize and generate excited particles, and the glow and the excited particles spread very quickly along the length of the insulated electrode. This action takes place in a matter of a few microseconds. The excited particles provided by this action are present along the length of electrode 120, and their presence adjacent to the reset cathode insures that all of the reset cells turn on when the reset driver 210R is operated. With all of the reset cells turned on, the excited particles generated thereby and diffusing through slots 80 insure that all of the scanning cells in the first column turn on at the beginning of the scanning cycle.

It is noted that the principles of the invention described herein are also useful with the type of SELF-SCAN panels described and claimed in copending application Ser. No. 635,918, filed Nov. 28, 1975, and Ser. No. 636,919, filed Dec. 2, 1975 as a continuation of application Ser. No. 551,359, filed Feb. 20, 1975, and now abandoned.

What is claimed is:

1. A display panel comprising a gas-tight envelope containing an ionizable gas, a plurality of gas discharge cells, each having spaced-apart discharge electrodes, disposed within said envelope in an array of rows and columns, there being a first column of cells, a last column of cells, and a plurality of intermediate columns of cells therebetween, said cells being adapted to be energized sequentially column by column, beginning with the first and continuing to the last, a column of reset cells, each having spaced-apart discharge electrodes, adjacent to said first column of gas discharge cells to turn on at the beginning of a scanning cycle, an auxiliary electrode in said envelope insulated from the gas in said envelope and positioned adjacent to said column of reset cells, and means for producing glow and excited particles along the length of said auxiliary electrode, said excited particles assisting all of the cells in said column of reset cells to exhibit glow and to generate excited particles.

2. The panel defined in claim 1 wherein said auxiliary electrode comprises a conductor coated with a layer of insulation.

3. The panel defined in claim 1 wherein said auxiliary electrode is a glass-coated conductor.

4. The panel defined in claim 1 wherein said spaced-apart discharge electrodes include an array of anode electrodes associated with each row of said discharge cells and a plurality of cathode electrodes, each associated with a column of said discharge cells, there being a first cathode, a last cathode, and intermediate cathodes, and a reset cathode associated with said column of reset cells adjacent to said first cathode.

5. A display panel comprising a gas-tight envelope containing an ionizable gas, a plurality of gas discharge display cells, each having spaced-apart discharge electrodes, disposed within said envelope in an array of rows and columns, a plurality of gas discharge priming cells, each having spaced-apart discharge electrodes, disposed within said envelope in an array of rows and columns, each such priming cell being located adjacent one of said display cells with an open area of gas coupling communication between it and the adjacent display cell, there being a first column of priming cells, a last column of priming cells, and a plurality of intermediate columns of priming cells therebetween, a column of reset cells, each having spaced-apart discharge electrodes, adjacent to said first column of priming cells to turn on at the beginning of a scanning cycle, an auxiliary electrode in said envelope insulated from the gas in said envelope and positioned adjacent to said column of reset cells, and means for producing glow and excited particles along the length of said auxiliary electrode, said excited particles assisting all of the cells in said column of reset cells to exhibit glow and to generate excited particles.

* * * * *